United States Patent [19]

Harmon

[11] Patent Number: 4,928,149

[45] Date of Patent: May 22, 1990

[54] CONTAMINANT CLEANER

[75] Inventor: James E. Harmon, Fairport, N.Y.

[73] Assignee: Xerox Corporation, Stamford, Conn.

[21] Appl. No.: 318,388

[22] Filed: Mar. 3, 1989

[51] Int. Cl.[5] ..... G03G 15/08; G03G 15/09

[52] U.S. Cl. ..... 355/305; 355/296; 355/298; 15/256.5

[58] Field of Search ..... 355/296, 298, 305; 15/256.15, 1.5

[56] References Cited

U.S. PATENT DOCUMENTS

| | | | |
|---|---|---|---|
| 3,659,311 | 5/1972 | Waren | 15/256.5 |
| 4,043,298 | 8/1977 | Swackhamer | 118/652 |
| 4,108,546 | 8/1978 | Rezanka | 355/15 |
| 4,210,397 | 7/1980 | Macaluso et al. | 355/15 |
| 4,260,243 | 4/1981 | Dolan et al. | 355/15 |
| 4,515,467 | 5/1985 | Suzuki | 355/305 |
| 4,552,451 | 11/1985 | Yamazaki | 355/305 |
| 4,823,102 | 4/1989 | Cherian et al. | 355/305 X |
| 4,829,338 | 5/1989 | Whittaker et al. | 355/305 |

*Primary Examiner*—A. C. Prescott

*Attorney, Agent, or Firm*—H. Fleischer; J. E. Beck; R. Zibelli

[57] ABSTRACT

A device for use in an electrophotographic printing machine which prevents magnetic particles moving with a photoconductive belt from contaminating processing stations located thereafter. A magnet is mounted on a support located before one of the processing stations. The magnet generates a magnetic flux field attracting magnetic particles moving with the photoconductive belt to prevent contamination of processing stations located thereafter.

15 Claims, 2 Drawing Sheets

CONTAMINANT CLEANER

The invention relates generally to an electrophotographic printing machine, and more particularly concerns a device which prevents contamination of processing stations in the printing machine by particles being transported on a photoconductive member.

In a typical electrophotographic printing process, the photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder is then transferred from the photoconductive member to a copy sheet. After transfer of the toner powder image, the residual particles adhering to the photoconductive member are cleaned therefrom. The toner particles on the copy sheet are heated to permanently affix the toner powder image to the copy sheet.

In a printing machine of the foregoing type, it is essential to prevent any large particles, i.e. carrier granules or any other large particles, from being introduced into the development system. These particles may scratch the photoconductive member or contaminate the cleaning system, transfer system and developer material resulting in premature failure of the printing machine. Large particles entering the the transfer system will cause debris centered deletions. In addition, large particles entering the cleaning system will cause brush contamination and scratches on the photoconductive member. Furthermore, these particles must be prevented from entering into the corona generating devices used in the printing machine. In the event large particles are introduced into the corona generating devices, arcing may occur. If arcing is at a sufficiently high voltage, the corona generator and/or the photoconductive member can be damaged reducing print quality. Also, the arc detection system of the printing machine will disable the printing machine. As a result of the printing machine being disabled, the volume of copies being produced decreases and machine shut down time increases.

Various approaches have been devised for removing particles and contaminants from the photoconductive member, the following disclosures appear to be relevant:

U.S. Pat. No. 3,659,311;
Patentee: Waren;
Issued: May 2, 1972,
U.S. Pat. No. 4,043,289;
Patentee: Swackhamer;
Issued Aug. 23, 1977,
U.S. Pat. No. 4,108,546;
Patentee: Rezanka;

Issued: Aug. 22, 1978,
U.S. Pat. No. 4,210,397;
Patentee: Macaluso et al;
Issued July 1, 1980,
U.S. Pat. No. 4,620,243;
Patentee: Dolan et al.;
Issued: Apr. 7, 1981, The pertinent portions of the foregoing patents may be summarized as follows:

U.S. Pat. No. 3,659,311 discloses a plurality of magnets rotating in a tube adjacent a photoreceptor to attract magnetic powder thereto. The magnetic powder is guided over a curved surface to a collection trough.

U.S. Pat. No. 4,043,289 and U.S. Pat. No. 4,108,546 describe a magnetic cleaning system in which magnets are positioned interior of drums or belts. The cleaning system is positioned adjacent a photoreceptor. The magnetic force generated by the magnets attracts magnetic particles to the drum or belt which moves the particles away from the photoreceptor.

U.S. Pat. No. 4,210,397 and U.S. Pat. No. 4,620,243 disclose a shield positioned adjacent a photoreceptor with a magnet located on the side of the shield opposed from the photoreceptor. The magnet attracts magnetic particles into the shield. The magnet may be an electromagnet and the shield may be removable to facilitate removal of the particles.

In accordance with one aspect of the present invention, there is provided a device for preventing particles being transported on a moving image receiving member from contaminating processing stations located thereafter The device includes a support member positioned before the processing station in the direction of movement of the image receiving member. Means, mounted on the support member, attract magnetic particles advancing with the image receiving member to prevent the magnetic particles from contaminating the processing station located thereafter.

Pursuant to another aspect of the features of the present invention, there is provided an electrophotographic printing machine of the type having a plurality of processing stations operatively associated with a moving photoconductive member for forming a developed image thereon. The improvement includes a support member positioned before a processing station in the direction of movement of the photoconductive member. Means, mounted on the support member, attract magnetic particles moving with the photoconductive member to prevent the particles from advancing with the photoconductive member from contaminating the processing station located thereafter.

Other aspects of the present invention will become apparent as the following description proceeds and upon reference to the drawings, in which.

While the present invention will hereinafter be described in connection with a preferred embodiment thereof, it will be understood that is not intended to limit the invention to that embodiment. On the contrary, it is intended to cover all alternatives, modifications, and equivalents, as may be included within the spirit and scope of the invention as defined by the appended claims.

Figure 1:
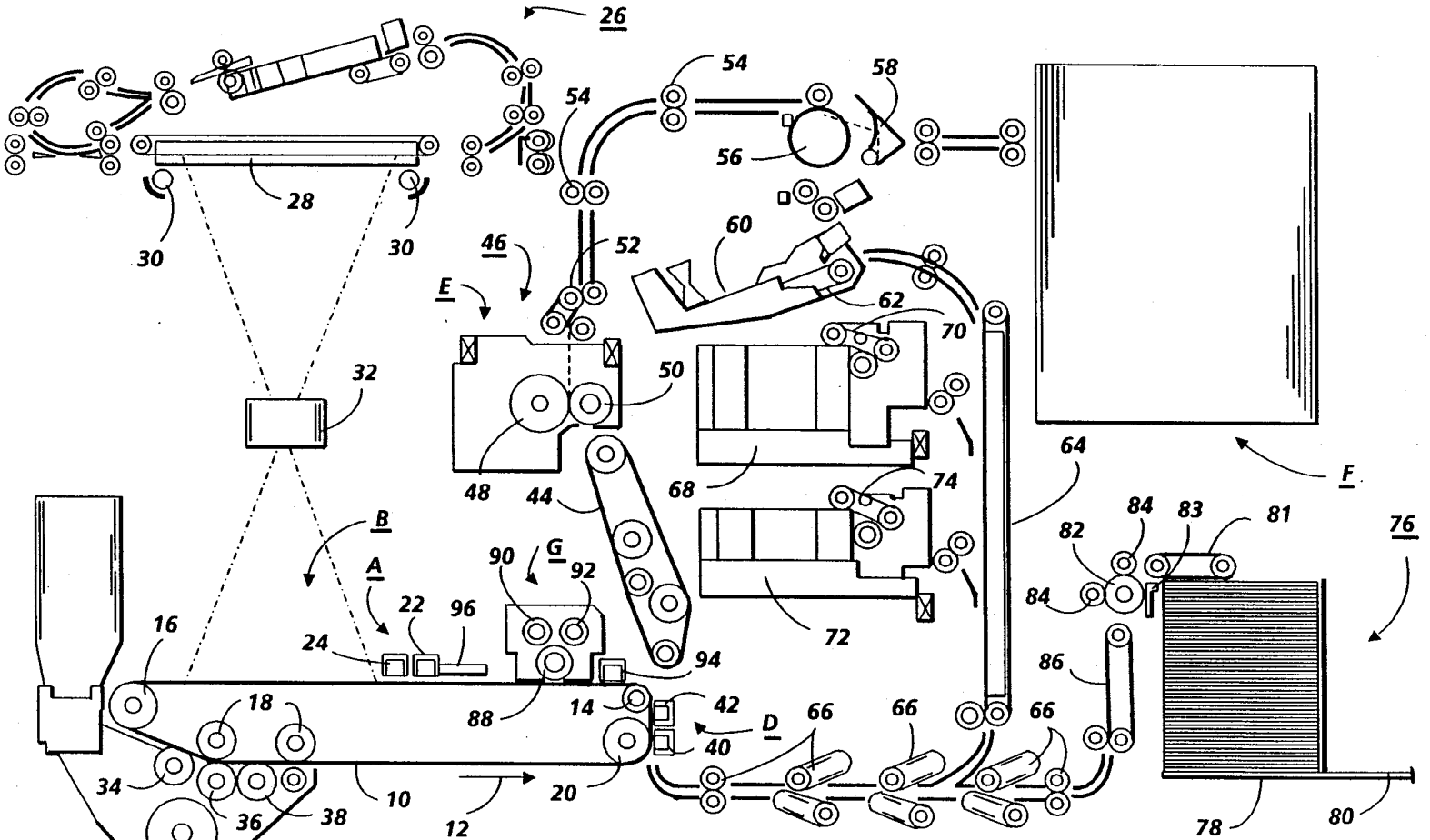
FIG. 1 is a schematic elevational view depicting an illustrative electrophotographic printing machine incorporating a cleaning device having the features of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the device of the present invention may be employed in a wide variety of printing machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-mtolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24, charge the photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds original documents from a set of documents placed by the operator face up in a normal forward collated order in the document stacking and holding tray. A document feeder located below the tray forwards the bottom document in the set to a pair of take-away rollers. The bottom sheet is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the top of the set of original documents through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of photoconductive belt 10 to selectively dissipate the charge thereon. This records an electrostatic latent image on the photoconductive belt which corresponds to the informational areas contained within the original document. Thereafter, belt 10 advances the electrostatic latent image recorded to development station C.

Development station C has three magnetic brush developer rolls, indicated generally by the reference numerals 34, 36 and 38. A paddle wheel picks up developer material and delivers it to the developer rolls. When developer material reaches rolls 34 and 36, it is magnetically split between the rolls with half the developer material being delivered to each roll. Photoconductive belt 10 is partially wrapped about rolls 34 and 36 to form extended development zones. Developer roll 38 is a cleanup roll. A magnetic roll, positioned after developer roll 38, in the direction of arrow 12, is a carrier granule removal device adapted to remove any carrier granules adhering to belt 10. Thus rolls 34 and 36 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 40 charges the copy sheet to the proper magnitude and polarity so that the copy sheet is tacked to photoconductive belt 10 and the toner powder image attracted from the photoconductive belt to the copy sheet. After transfer, corona generator 42 charges the copy sheet to the opposite polarity to detack the copy sheet from belt 10. Conveyor 44 advances the copy sheet to fusing station E.

Fusing station E includes a fuser assembly, indicated generally by the reference numeral 46 which permanently affixes the transferred toner powder image to the copy sheet. Preferably, fuser assembly 46 includes a heated fuser roller 48 and a pressure roller 50 with the powder image on the copy sheet contacting fuser roller 48. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 52. Decurler 52 bends the copy sheet in one direction to put a known curl in the copy sheet and then bends it in the opposite direction to remove that curl.

Forwarding rollers 54 then advance the sheet to duplex turn roll 56. Duplex solenoid gate 58 guides the sheet to the finishing station F or to duplex tray 60. At finishing station F, copy sheets are stacked in compiler trays to form sets of copy sheets. The sets of copy sheets may remain unfinished or may be finished by being attached to one another. The sheets of each set are attached to one another by either a binding device or a stapling device. In either case, a plurality of finished or unfinished sets of copy sheets are formed in finishing station F. The sets of copy sheets are delivered to a stacker. In the stacker, each batch of copy sheets is offset from the next successive batch of copy sheets. The operator selects the number of copy sheets in a batch. The batch can correspond to a set of copy sheets, or be more than or less than a set of copy sheets.

With continued reference to FIG. 1, when duplex solenoid gate 58 diverts the sheet into duplex tray 60. Duplex tray 60 provides an intermediate or buffer storage for those sheets that have been printed on one side and on which an image will be subsequently printed on the second, opposed side thereof, i.e. the sheets being duplexed. The sheets are stacked in duplex tray 60 face down on top of one another in order in which they are copied.

In order to complete duplex copying, the simplex sheets in tray 60 are fed, in seriatim, by bottom feeder 62 from tray 60 back to transfer station D via conveyor 64 and rollers 66 for transfer of the toner powder image to the opposed sides of the copy sheets. Inasmuch as successive bottom sheets are fed from duplex tray 60, the proper or clean side of the copy sheets is positioned in contact with belt 10 at transfer station D so that the toner power image is transferred thereto. The duplex sheet is then fed through the same path as the simplex sheet to be advanced to finishing station F.

Copy sheets are fed to transfer station D from the secondary tray 68. The secondary tray 68 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 70. Sheet feeder 70 is a friction retard feeder utilizing a feed belt and take-away rolls to advance successive copy sheets to transport 64 which advances the sheets to rolls 66 and then to transfer station D.

Copy sheets may also be fed to transfer station D from the auxiliary tray 72. The auxiliary tray 72 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 74. Sheet feeder 74 is a friction retard feeder utilizing a feed belt and take-away rolls to advance successive copy sheets to transport 64 which advances the sheets to rolls 66 and then to transfer station D.

Secondary tray 68 and auxiliary tray 72 are secondary sources of copy sheets. A high capacity feeder, indicated generally by the reference numeral 76, is the primary source of copy sheets. High capacity feeder 76 includes a tray 78 supported on an elevator 80. The elevator is driven by a bidirectional AC motor to move the tray up or down. In the up position, the copy sheets are advanced from the tray to transfer station D. A fluffer and air knife 83 direct air onto the stack of copy sheets on tray 78 to separate the uppermost sheet from the stack of copy sheets. A vacuum pulls the uppermost sheet against feed belt 81. Feed belt 81 feeds successive uppermost sheets from the stack to an take-away drive roll 82 and idler rolls 84. The drive roll and idler rolls guide the sheet onto transport 86. Transport 86 advances the sheet to rolls 66 which, in turn, move the sheet to transfer station station D.

Invariably, after the copy sheet is separated from the photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 88 and two de-toning rolls 90 and 92, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

It is essential to prevent any large particles and metal chips from entering development station C. If these particles and chips enter development station C, they will be transported on developer rollers 34, 36 and 38 into contact with photoconductive belt 10 and scratch the belt In addition, if large particles are transported into charging station A, these particles will cause arcing in corona generator devices 22 and 24. Furthermore, large particles or metal chips entering cleaning station G may be imbedded in the cleansing brush scratching the photoconductive belt or damaging the internal parts of the cleaning station, such as the reclaim/waste rolls and cleaner blades. To prevent any large particles which have not been removed from the photoconductive belt at cleaning station G from being transported into charging station A, a magnet 96 is positioned closely adjacent photoconductive belt 10 after cleaning station G, between charging station A and cleaning station G. Magnet 96 attracts magnet particles thereto and collects large particles preventing these particles from being transported on photoconductive belt 10 to charging station A and development station C. While a magnet has been shown as being located after cleaning station G and before cleaning station A, one skilled in the art will appreciate that another magnet can be positioned between development station C and transfer station D. This magnet protects transfer station D and cleaning station G. This magnet will prevent poor transfer of the toner image and helps to eliminate electrical arcing in the corona generating devices. Further details of magnet 96 will be described hereinafter with reference to FIG. 2.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
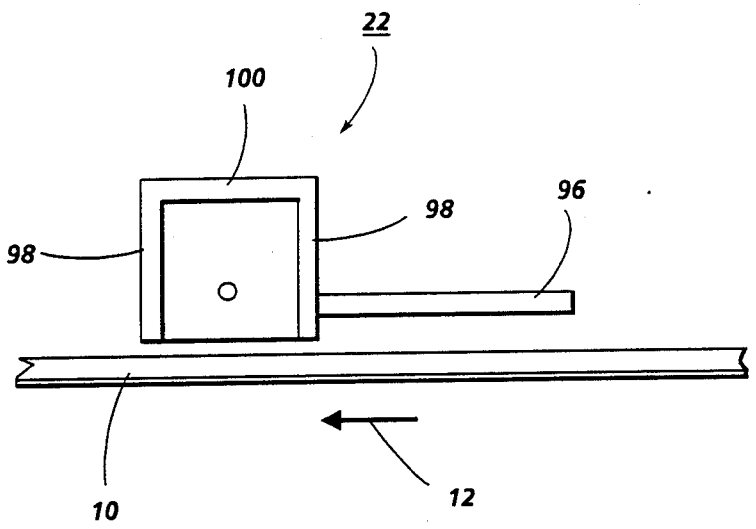
FIG. 2 is n exploded elevational view showing the cleaning device used in the the FIG. 1 printing machine.

Referring now to FIG. 2, magnet 96 is an elongated magnet extending across the width of belt 10 in a direction substantially perpendicular to the direction of movement of belt 10, as indicated by arrow 12. Magnet 96 is mounted on corona generator 22. By way of example, corona generator 22 includes a shield 100 having a pair of legs 98. One end of magnet 96 is mounted on the up stream leg 98 so as to position magnet 96 before the corona generator 22, in the direction of movement of belt 10, as indicated by arrow 12. Preferably, magnet 96 has a high magnetic flux density of about 1000 gauss or greater. Magnet 96 is mounted on leg 98 such that the space between the surface of belt 10 opposed from the opposite surface of magnet 96 is about 3 millimeters. Thus, magnet 96 is positioned after cleaning station G and before charging statio A and development station C, in the direction of movement of belt 10, as indicated by arrow 12. Magnet 96 generates a magnetic flux field which attracts magnetic particles moving with photoconductive belt 10. The magnet collects the large particles and magnetic debris preventing them from entering charging station A and development station C. Magnet 96 is mounted removably in the printing machine. This permits the operator to periodically clean or remove the particles therefrom before they scratch the photoconductive belt. This is achieved by having the support for magnet 96, i.e. corona generator 22, mounted slidably on the printing machine frame. This enable the machine operator to slide corona generator 22 with magnet 96 thereon out of the printing machine for cleaning, i.e. removal of any particles adhering thereto. Of course, one skilled in the art will appreciate that magnet 96 may be mounted slidably on corona generator 22 so as to be operator removable independent of corona generator 22. Moreover, the magnet may be supported by a drawer mounted slidably in the printing machine between cleaning station G and charging station A. In any case, magnet 96 is readily removable from the printing machine by the operator for cleaning. In lieu of a simple magnet, a magnetic roll having a catch tray and drive system associated therewith may be employed. The magnetic roll includes a sleeve having a magnet disposed internally thereof. The drive system rotates the sleeve. As the sleeve rotates, the magnetic flux field generated by the magnet attracts magnetic particles from the photoconductive belt to the sleeve. The magnet generates a magnetic flux field over a portion of the peripheral surface of the sleeve, the remainder of the sleeve is free of the magnetic field. In the this field free region, the large magnetic particles adhering to the sleeve are scraped and fall freely into a tray. The tray is periodically removed form the printing machine by the operator for cleaning. In any event, the magnets must be periodically cleaned to prevent a build-up of magnetic particles thereon which will scratch the photoconductive belt and disturb the toner power image. The magnetic particles are always spaced from the toner powder image and photoconductive belt. The magnet prevents magnetic debris from entering downstream processing stations and contributing or causing damage thereat. Multiple magnets protect the next successive processing station from magnetic debris. Under these conditions, one failing or debris generating processing station is less likely to damage other processing stations. In addition, the measure of contamination on each magnet is very useful in detecting early subsystem and component failure.

In recapitulation, the device of the present invention has an operator removable magnet positioned before a processing station. The magnet generates a high magnetic flux field and is spaced from the photoconductive belt. The magnetic flux field attracts magnetic particles being transported on the belt to prevent large particles from being transported on the photoconductive belt into the processing station.

It is, therefore, evident that there has been provided, in accordance with the present invention, a device that fully satisfies the aims and advantages with the present invention, a device that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A device for preventing particles being transported on a moving image receiving member from contaminating processing stations located thereafter, including:

a support member positioned before the processing station in the direction of movement of the image receiving member; and operator removable means, mounted on said support member, for attracting magnetic particles advancing with the image receiving member to prevent the magnetic particles from contaminating the processing station located thereafter.

2. A device according to claim 1, wherein said attracting means includes magnetic means for producing a magnetic flux field attracting the magnetic particles advancing with the image receiving member.

3. A device according to claim 2, wherein said magnetic means includes a magnetic member mounted on said support member with said support member spacing said magnetic member from the image receiving member.

4. A device for preventing particles being transported on a moving image receiving member from contaminating processing stations located thereafter, including:

a support member positioned before the processing station in the direction of movement of the image receiving member; and means, mounted on said support member, for attracting magnetic particles advancing with the image receiving member to prevent the magnetic particles from contaminating the processing station located thereafter, said attracting means comprises magnetic means for producing a magnetic flux field attracting the magnetic particles advancing with the image receiving member, said magnetic means comprises a magnetic member mounted on said support member with said support member spacing said magnetic member from the image receiving member, said magnetic member is mounted slidably on said support member so as to be operator removable.

5. A device according to claim 4, wherein said magnetic member generates a magnetic flux field of at least 1000 gauss.

6. A device according to claim 5, wherein said support member spaces said magnetic member a distance of about 3 millimeters from the image receiving member.

7. A device according to claim 4, wherein said support member is located after a cleaning station.

8. An electrophotographic printing machine of the type having a plurality of processing stations operatively associated with a moving photoconductive member for forming a developed image thereon, wherein the improvement includes:

a support member positioned before a processing station in the direction of movement of the photoconductive member; and operative removable means, mounted on said support member, for attracting magnetic particles moving with the photoconductive member to prevent the particles from advancing with the photoconductive member from contaminating the processing station located thereafter.

9. A printing machine according to claim 8, wherein said forming means includes magnetic means for producing a magnetic flux field attracting magnetic particles advancing with the photoconductive member.

10. A printing machine according to claim 9, wherein said magnetic means includes a magnetic member mounted on said support member with said support member spacing said magnetic member from the photoconductive member.

11. An electrophotographic printing machine of the type having a plurality of processing stations operatively associated with a moving photoconductive member for forming a developed image thereon, wherein the improvement includes:

a support member positioned before a processing station in the direction of movement of the photoconductive member; and means, mounted on said support member, for attracting magnetic particles moving with the photoconductive member to prevent the particles from advancing with the photoconductive member from contaminating the processing station located thereafter, said forming means comprises magnetic means for producing a magnetic flux field attracting magnetic particles advancing with the photoconductive member, said magnetic means comprises a magnetic member mounted on said support member with said support member spacing said magnetic member from the photoconductive member, said support member is mounted slidably in the printing machine so that said magnetic member is operator removable.

12. A printing machine according to claim 11, wherein said magnetic member generates a magnetic flux field of at least 1000 gauss.

13. A printing machine according to claim 12, wherein said support member spaces said magnetic member a distance of about 3 millimeters from the photoconductive member.

14. A printing machine according to claim 11 in which one of the processing stations is a cleaning station adapted to remove particles from the moving photoconductive member after the transfer of a developed image therefrom to copy sheet, wherein said support member is located after the cleaning station.

15. A printing machine according to claim 11 in which one of the processing station is corona generator adapted to charge at least a portion of the photoconductive member to a substantially uniform level after that portion has passed through the cleaning station, wherein said support member includes a portion of the corona generator.

* * * * *